US009487990B2

(12) United States Patent
Van Mill et al.

(10) Patent No.: US 9,487,990 B2
(45) Date of Patent: Nov. 8, 2016

(54) DUAL POSITION DOOR CONTROL FOR FARM IMPLEMENT

(71) Applicant: Unverferth Manufacturing Company, Inc., Kalida, OH (US)

(72) Inventors: Michael Van Mill, Shell Rock, IA (US); Ronald J. Schlimgen, Shell Rock, IA (US)

(73) Assignee: Unverferth Manufacturing Company, Inc., Kalida, OH (US)

( * ) Notice: Subject to any disclaimer, the term of this patent is extended or adjusted under 35 U.S.C. 154(b) by 346 days.

(21) Appl. No.: 13/828,578

(22) Filed: Mar. 14, 2013

(65) Prior Publication Data

US 2014/0151372 A1 Jun. 5, 2014

Related U.S. Application Data

(60) Provisional application No. 61/733,364, filed on Dec. 4, 2012.

(51) Int. Cl.
*E05F 11/44* (2006.01)

(52) U.S. Cl.
CPC ..... *E05F 11/44* (2013.01); *E05Y 2201/68* (2013.01); *E05Y 2900/11* (2013.01); *E05Y 2900/132* (2013.01)

(58) Field of Classification Search
CPC ..... E05F 11/44; E05F 11/00; E05F 11/10; E05Y 2201/68; E05Y 2900/11; E05Y 2900/132
USPC ..... 220/211; 49/341, 346, 353, 350; 298/24; 222/185.1, 248, 300, 505
See application file for complete search history.

(56) References Cited

U.S. PATENT DOCUMENTS 1,850,091 A * 3/1932 Bailey ..... E05F 11/54 49/362
5,842,619 A * 12/1998 Cousino ..... B65D 90/582 222/185.1

* cited by examiner

*Primary Examiner* — Fenn Mathew
*Assistant Examiner* — Elizabeth Volz
(74) *Attorney, Agent, or Firm* — Rothwell, Figg, Ernst & Manbeck, P.C.

(57) ABSTRACT

A door control system for a farm implement with a storage bin having a discharge opening and a door movable by a drive mechanism between open and dosed positions relative to the discharge opening includes a dual position door control system. The system may include an arm pivotally connected at one end to the storage bin such that the arm is rotatable between at least a first operating position and a second operating position and a controller connected to the arm and to the drive mechanism.

16 Claims, 8 Drawing Sheets

DUAL POSITION DOOR CONTROL FOR FARM IMPLEMENT

CROSS-REFERENCE TO RELATED APPLICATIONS

The present application claims priority to U.S. Provisional Patent Application No. 61/733,364, filed Dec. 4, 2012, the entire disclosure of which is incorporated herein by reference.

BACKGROUND OF THE INVENTION

1. Field of the Invention

The present invention relates generally to a gate or door control mechanism for a farm implement and, more particularly, to a gate or door mechanism for a farm implement which may be operated from at least two different positions in relation to the gate or door.

2. Description of the Related Art

Farm implements with storage bins, such as seed tenders, grain wagons, and the like, typically have a discharge opening with a gate or door movable between an open position exposing the discharge opening and a closed position covering the discharge opening. In such implements, a control mechanism is generally provided to move the gate between open and closed positions. These control mechanisms are generally configured to be operated from a single position in relation to the gate, e.g., to the right or left side of the gate. The positional bias of the mechanism for controlling the gate can be an inconvenience for users operating the grain cart, particularly when material is being discharged from an open gate and the user wants to close the gate, but finds themselves positioned on the wrong side of the control mechanism.

SUMMARY OF THE INVENTION

In accordance with a first aspect of the present invention, a multiple position door control assembly is configured to be attached to a farm implement adjacent a door or gate. The door control assembly includes an elongate arm mounted to pivot about a first end. A hand-operable controller, such as a hand wheel or crank is attached to a second end of the arm. In an embodiment, the controller is attached to the arm via a shaft with a first sprocket and a roller chain runs from the first sprocket to a second, larger sprocket on a second shaft adjacent the pivot point of the arm. The second shaft also has a gear fixed to it, and the gear meshes with a second larger gear fixed to a third shaft, upon which the door control assembly pivots. The third shaft also includes a third gear that meshes with a rack on the door to move the door up and down. In a preferred embodiment, the door may be automatically locked in position by a spring that pushes the shaft out to engage the sprocket teeth into a pin, and in such embodiment the operator must push in the wheel to unlock the door control assembly.

The door control assembly can be locked in one of at least two operating positions in relation to the door by a locking mechanism, e.g., a knob with a threaded shaft that engages a threaded opening in a mount on the farm implement. In an embodiment of the present invention, the farm implement includes at least two mounts. The process of moving the opener assembly between operating positions requires the knob to be loosened, removed or disengaged by the operator and then rotating the assembly from a first operating position to a second operating position or vice-versa and reengaging the knob with the shaft into the mount on the implement.

In accordance with a second aspect of the present invention, a multiple position door control assembly is configured to be attached to a farm implement adjacent a door or gate. The door control assembly includes an elongate arm mounted to pivot about a first end. A hand-operable controller, such as a hand wheel or crank is attached to a second end of the arm, e.g., via a shaft to a first gear. In an embodiment, the first gear is positioned to drive a second gear coupled to a first end of a second shaft when the hand-operable controller is adjusted. A third gear is coupled to a second end the second shaft, and the third gear is positioned to drive a fourth gear. The fourth gear is coupled to a first end of a third shaft, and a fifth gear is coupled to a second end of the third shaft. The fifth gear is positioned to mesh with a rack on the door to move the door up and down.

DETAILED DESCRIPTION OF THE PRESENT INVENTION

While the present invention may be embodied in many different forms, a number of illustrative embodiments are described herein with the understanding that the present disclosure is to be considered as providing examples and not intended to limit the invention to the preferred embodiments described and/or illustrated herein.

Figure 1:
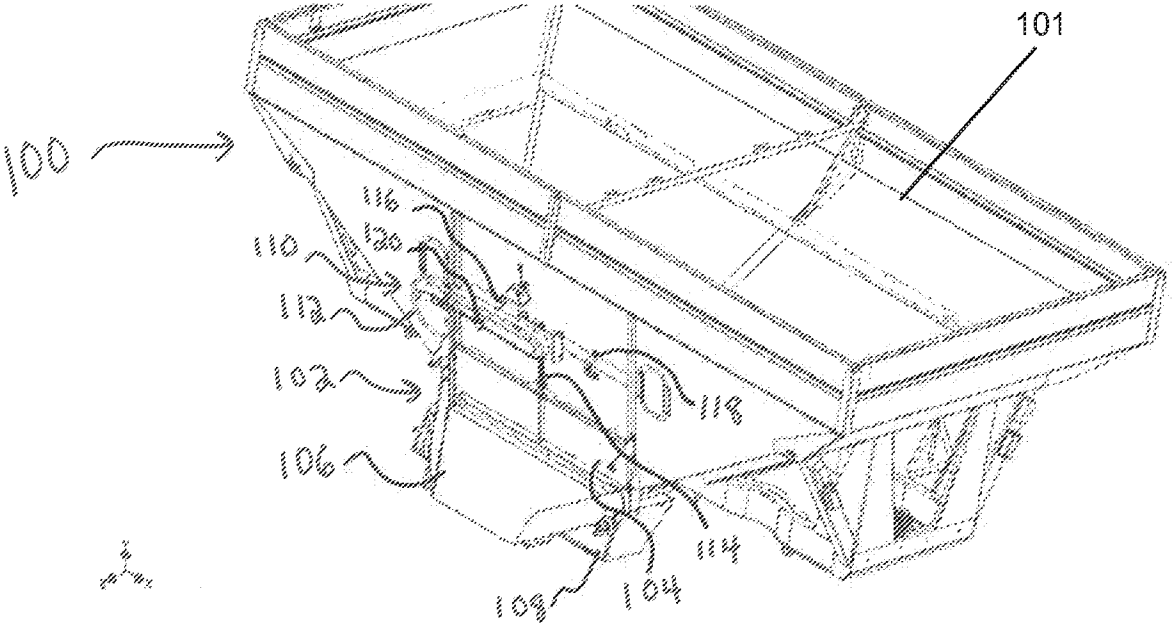
FIG. 1 illustrates a perspective view of a farm implement having a dual position door control according to an embodiment of the present invention.

FIG. 1 is a perspective view of a dual position door control assembly for a farm implement according to an embodiment of the present invention. The farm implement 100 includes a storage bin 101 for grain, seed, fertilizer, or like materials, a discharge 102 defining an opening for discharging material from the bin, a door or a gate 104 movable between a closed position covering the discharge opening and an open position exposing the discharge opening, a discharge spout 106, a kickback 108 and a door control assembly 110. The door 104 can be moved between the open and closed positions by the door control assembly 110. The door control assembly 110 includes a hand-operable controller 112, such as a hand wheel. As the controller 112 is adjusted the door opener assembly 110 engages a rack 114 on the door 104 which causes the door 104 to be moved up or down depending on the direction of the controller adjustment.

Figure 4:
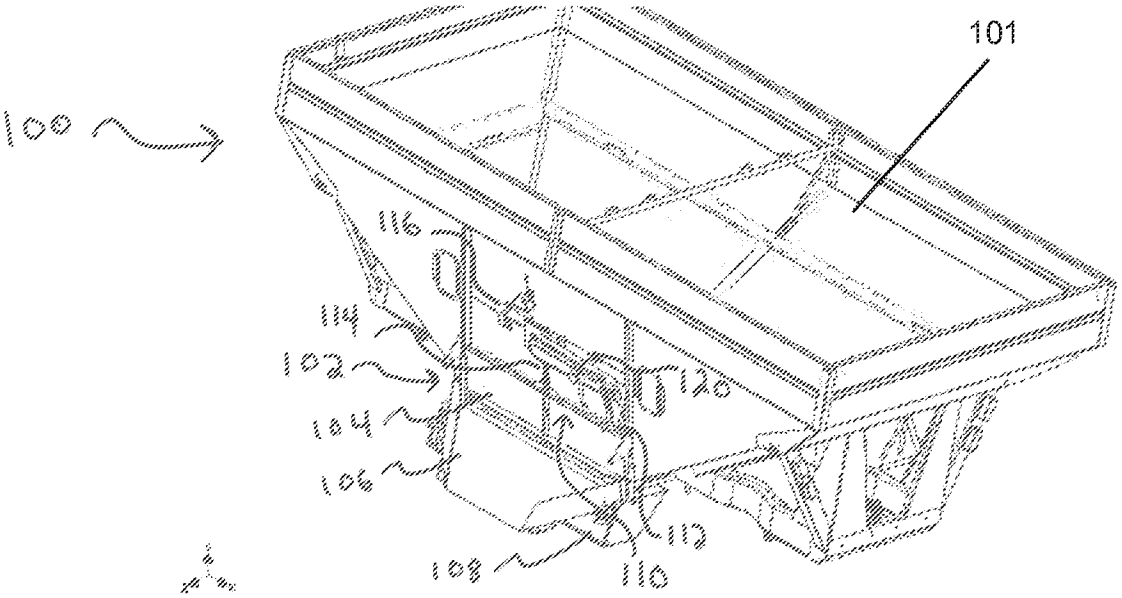
FIG. 4 illustrates a perspective view of a farm implement having dual position door control according to an embodiment of the present invention.
Figure 5A:
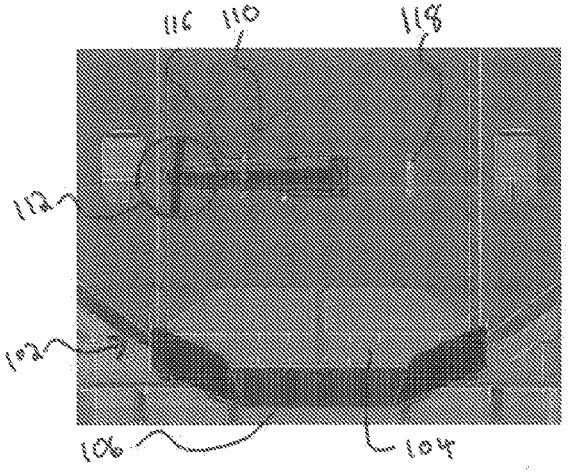
FIGS. 5*a-d* illustrate a dual position door control for a farm implement moving from a first position to a second position according to an embodiment of the present invention.
Figure 5B:
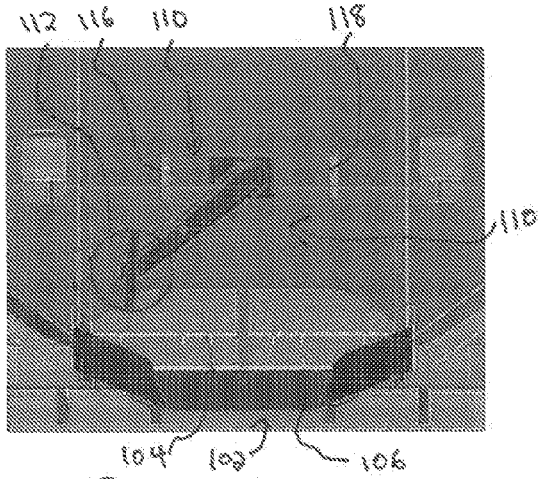
Figure 5C:
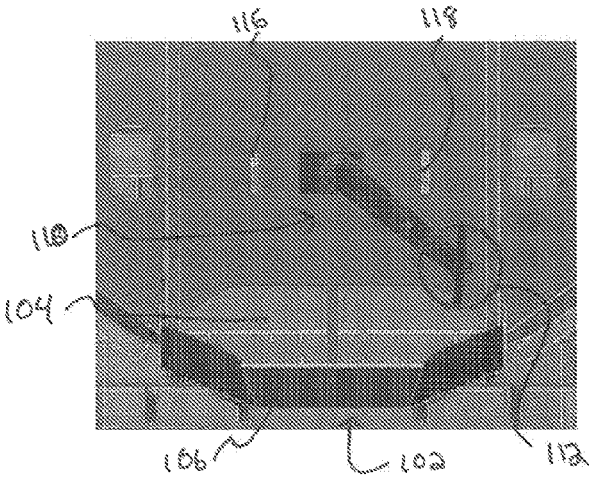
Figure 5D:
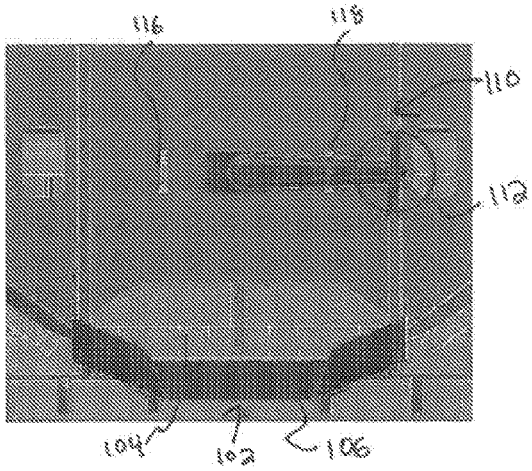

The door control assembly 110 can be placed in a first operating position (as shown in FIG. 1) or a second operating position (as shown in FIG. 4) by coupling the door control assembly 110 to a first mount 116 or a second mount 118, respectively, via a locking member 120. The door control assembly 110 includes an arm 122 and a mounting bracket 124. The mounting bracket 124 is fixedly coupled to the farm implement 100 adjacent the door 104 (e.g., vertically spaced above, and centered with, the door). The arm 122 is pivotably coupled to the mounting bracket 124 at one end. The first mount 116 is located on one side (e.g., to the left) of the mounting bracket 124, and the second mount 118 is located on the other side (e.g., to the right) of the mounting bracket 124.

Figure 2:
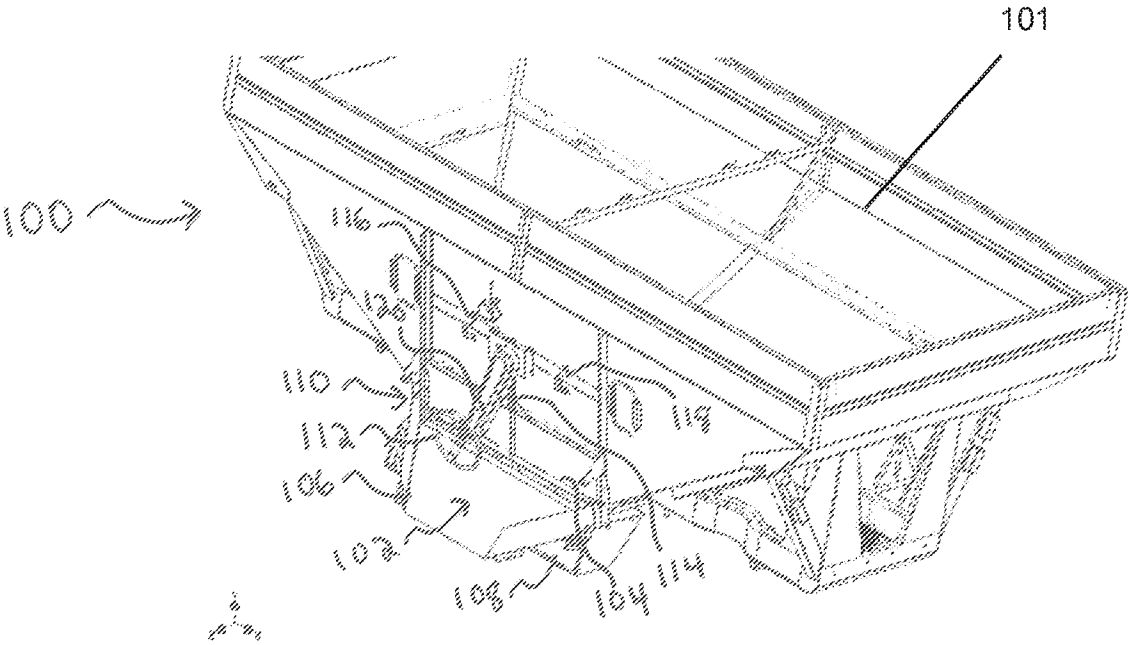
FIG. 2 illustrates a perspective view of a farm implement having a dual position door control according to an embodiment of the present invention.
Figure 3:
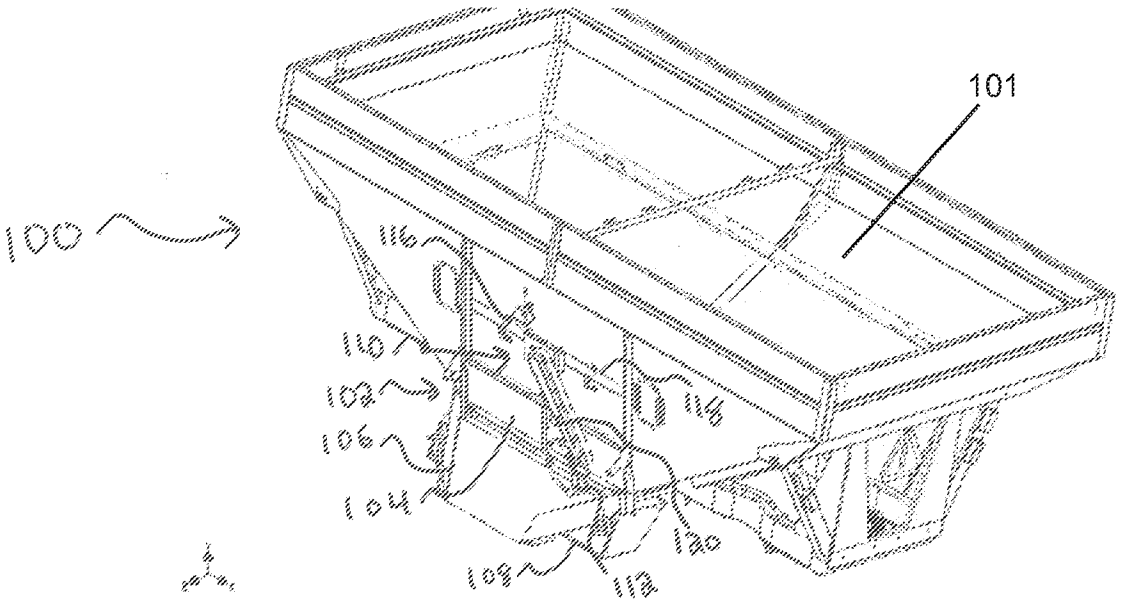
FIG. 3 illustrates a perspective view of a farm implement having a dual position door control according to an embodiment of the present invention.

In the first operating position, the door control assembly 110 is fixed to the first mount 116 by a locking member 120, such a knob with a threaded shaft, positioned in an opening of the arm 122 and coupled to the first mount 116, which includes a threaded opening therein for receiving the threaded shaft. In the second operating position, the door opener assembly 110 is fixed to the second mount 118 by the locking member 120 positioned in an opening of the arm 122 and coupled to the second mount 118, which includes another threaded opening for receiving the threaded shaft. The arm 122 can be pivoted about mounting bracket 124 to move the door control assembly 110 between the first operating position and the second operating position. FIGS. 2 and 3 illustrate the door control assembly 110 in intermediate pivoting positions between the first position and the second position, respectively. In the embodiment shown, the arm 122 of the door control assembly 110 is configured to pivot along only a lower portion (e.g., a lower half) of a circle centered on the mounting bracket 124 (i.e., counterclockwise from the first to second operating position and clockwise from the second to first operating position); although it is within the scope of the invention to configure the arm 122 to pivot along only an upper portion of the circle, a side portion of the circle, or along all portions of the circle.

In an embodiment of the present invention, the length of the arm 122 is about half the width of the door 102 so that, in the first and second position, the controller is generally vertically aligned with respective sides of the door. In an embodiment of the present invention, the lateral distance between the controller 112 in the first and second position is more than an arm's length. In an embodiment of the present invention, the distance between the mounting bracket 124 and an edge of the door (e.g., the top of the door) is more than the length of the arm 122 to permit the arm to pivot without interfering with the flow from the door.

FIGS. 5*a-d* illustrate a side view of a door control assembly 110 moving from a first position to the second position. The door control assembly 110 is in a fixed position when it is attached to the farm implement 100 by the locking member 120 at the first mount 116 or the second mount 118. The arm 122 of door control assembly 110 can be pivoted about the mounting bracket 124 when it is not locked in an operating position relating to the farm implement 100 by the locking member 120. The arm 122 can be seen pivoting about the mounting bracket 124 in FIGS. 2, 3 and 5*b-c*.

Figure 6:
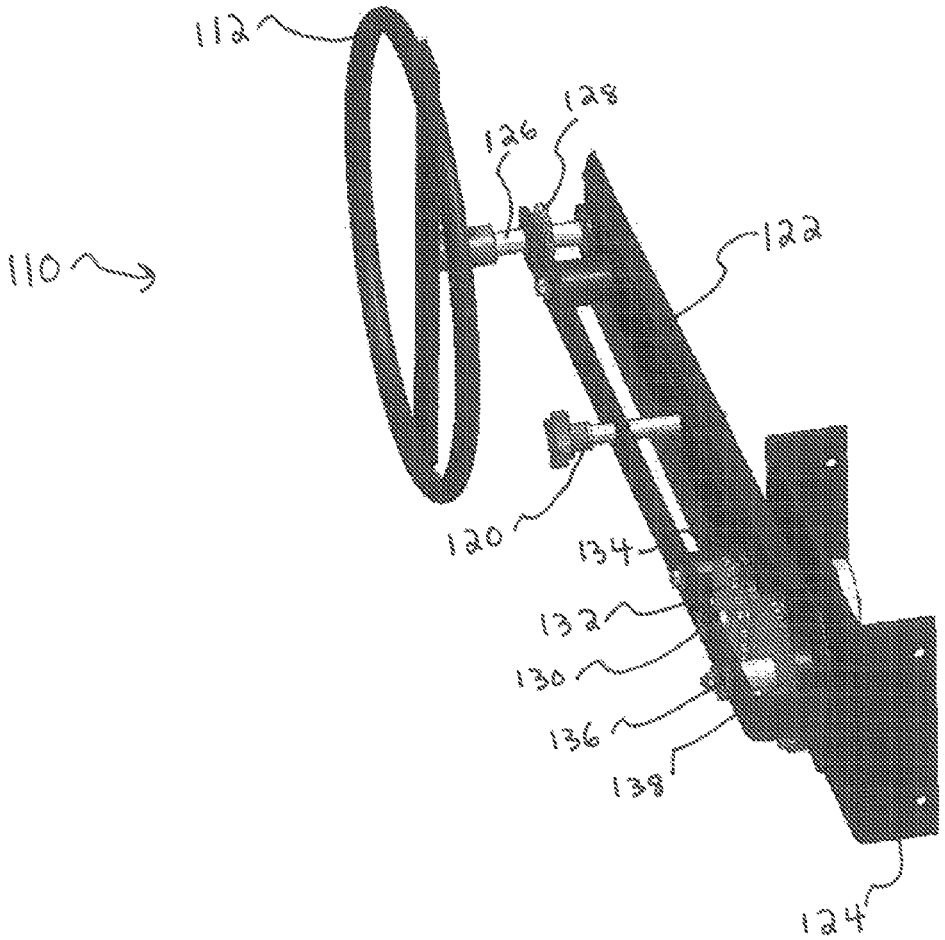
FIG. 6 illustrates a perspective view of a dual position door control according to an embodiment of the present invention.

FIG. 6 illustrates a perspective view of a door control assembly 110 according to an embodiment of the present invention. The door control assembly 110 includes a controller 112, a first shaft 126 and a first sprocket 128. The controller 112 is coupled to an end of the first shaft 126 and the first sprocket 128 is fixed to the first shaft 126. The first shaft 126 is rotatably coupled to an end of the arm 122 such that when the controller 112 is moved the first shaft 126 and the first sprocket 128 rotate. The door opener assembly 110 also includes a second shaft 130, a second sprocket 132 and a first gear 134. The first sprocket 128 is coupled with the second sprocket 132 such that any rotation of the first sprocket 128 is transferred to the second sprocket 132. The second sprocket 132 is fixed to the second shaft 130 such that any rotation of the second sprocket 132 is transferred to the second shaft 130. In an embodiment of the present invention, the first sprocket 128 is coupled to the second sprocket 132 by a roller chain 142 (see FIG. 7). The first sprocket 128 and the second sprocket 132 can be approximately circular disc-like members with a plurality of protrusions or teeth about a circumference thereof configured to couple with the roller chain. In an embodiment of the present invention, the second sprocket 132 is smaller than the first sprocket 128 to provide more than one rotation of the second sprocket 132 in response to one rotation of the first sprocket 128 (i.e., faster door movement). The first gear 134 is fixed to the second shaft 130 such that it rotates with the shaft 130. Alternatively, the first and second sprockets can be the same size, or the first sprocket 128 can be larger than the second sprocket 132 to provide slower door movement but increased mechanical advantage.

Figure 7:
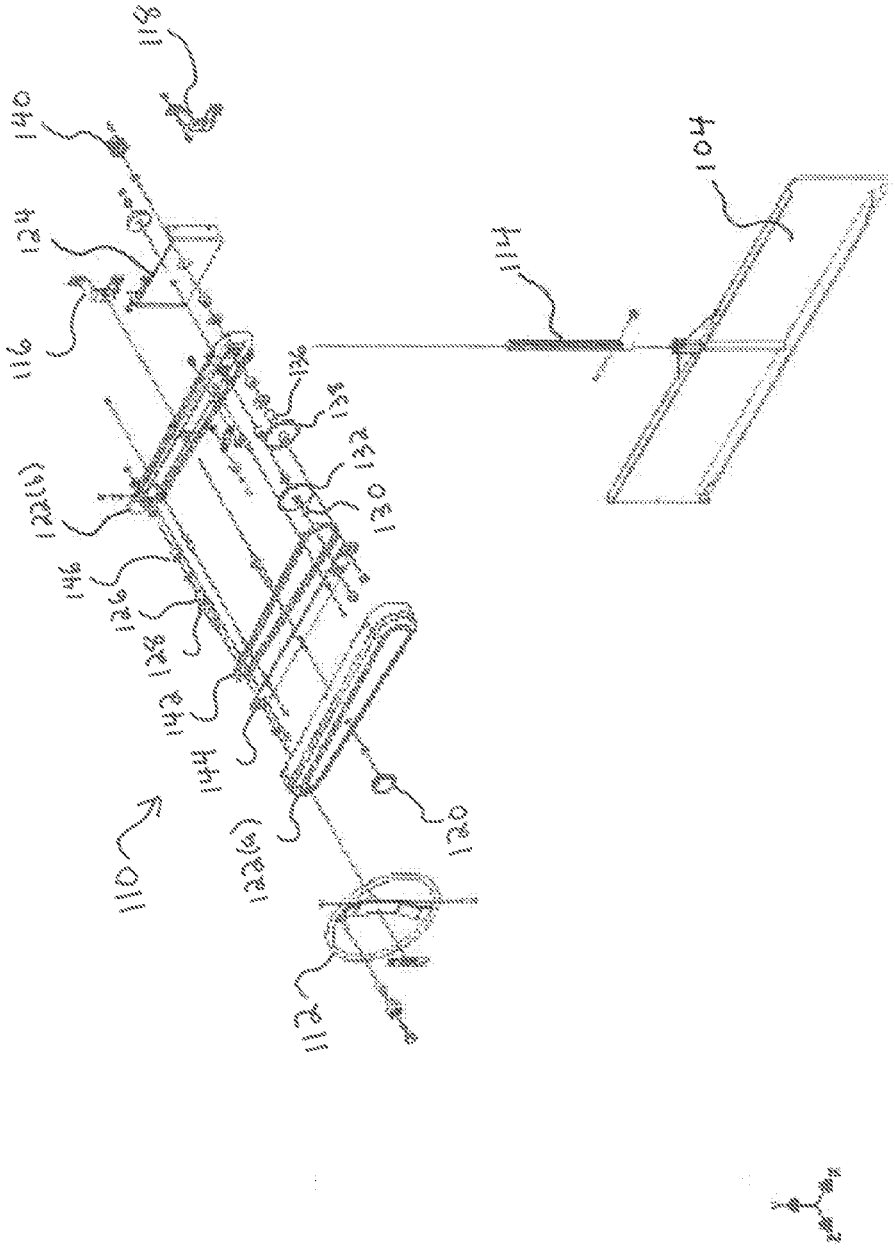
FIG. 7 illustrates an exploded view of a dual position door control according to an embodiment of the present invention.

In the embodiment shown, the door control assembly 110 also includes a third shaft 136, a second gear 138, and a third gear 140 (see FIG. 7). The second gear 138 is engaged with the first gear 134 such that as the first gear 134 rotates it drives the second gear 138. In an embodiment of the present invention, the first gear 134 and the second gear 138 each include a plurality of teeth and the gears are positioned such that teeth in the first gear 134 engage teeth in the second gear 138. In an embodiment of the present invention, the second gear 138 is larger than the first gear 134. The second gear 138 is fixed to the third shaft 136 such that the rotation of the second gear 138 causes the third shaft 136 to rotate. The third shaft 136 is positioned such that it passes through the mounting bracket 124. The third gear 140 is fixed to the third shaft 136 and positioned between the mounting bracket 124 and a wall of the farm implement 100. The third gear 140 is configured to engage the rack 114 and the rotation of the third gear 140 drives the rack 114, which causes the door 104 to move up or down. In an embodiment of the present invention, the third gear 140 is an approximately circular disc-like member including a plurality of teeth about a circumference thereof and the rack 114 is an elongated member that includes a plurality of teeth arranged in a linear manner. The third gear 140 and the rack 114 are positioned such that the teeth of the third gear 140 engage the teeth of the rack 114.

FIG. 7 illustrates an exploded view of the door control assembly 110. The arm 122 can include a first member 122(*a*) and a second member 122(*b*). The first member 122(*a*) and second member 122(*b*) can be parallel and spaced apart to define a gap for the shaft and sprockets (i.e., the drive mechanism). The members can be positioned such that at least a portion of the shafts span between the first and second members 122(*a*) and (*b*) and all of the gears and sprockets except the third gear 140 are positioned between the arm members. The arm 122 can include a support member 144 which couples with the first member 122(*a*). In an embodiment of the present invention, the door 104 is locked in position and prevented from moving (i.e., immobilized) by a spring 146 that biases the first sprocket 128 towards a pin in the support member 144 that prevents first sprocket 128, and, therefore, the first shaft 126, from rotating. An operator can unlock the first sprocket 128 by pressing in the control member 112, which causes the spring 146 to compress and moves the first sprocket 128 out of engagement with the pin on the support member 144, allowing the sprocket to rotate. As can be seen in FIG. 7, the arm 122 and the shafts 126, 130 and 136 can include coupling members to keep the assembly together, e.g., connectors such as washers, bolts, weldments etc.

Figure 8A:
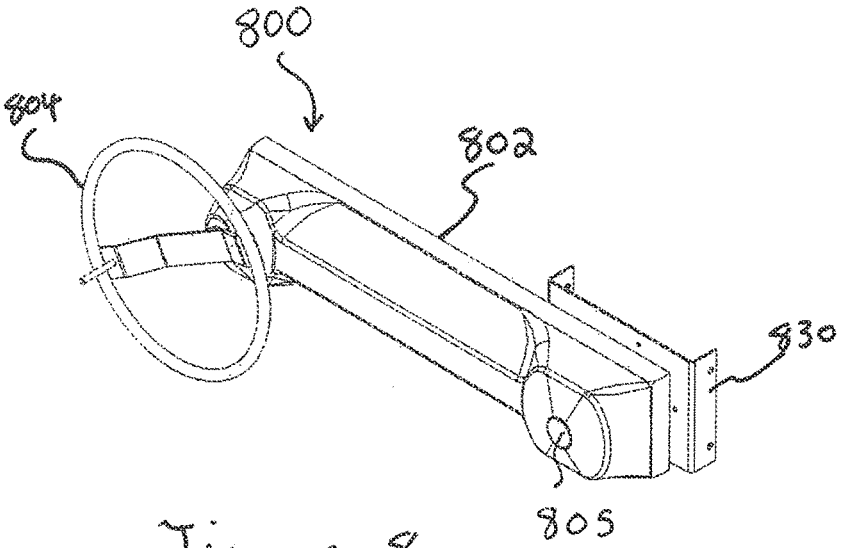
FIGS. 8*a-c* illustrate a dual position door control for a farm implement according to an embodiment of the present invention.
Figure 8B:
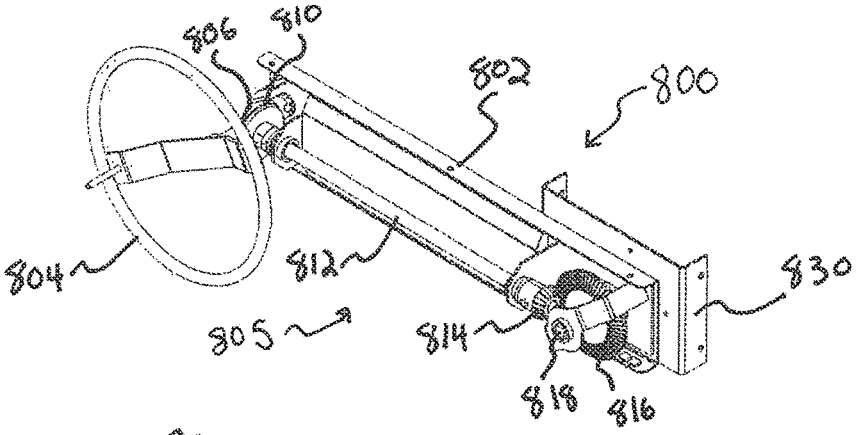
Figure 8C:
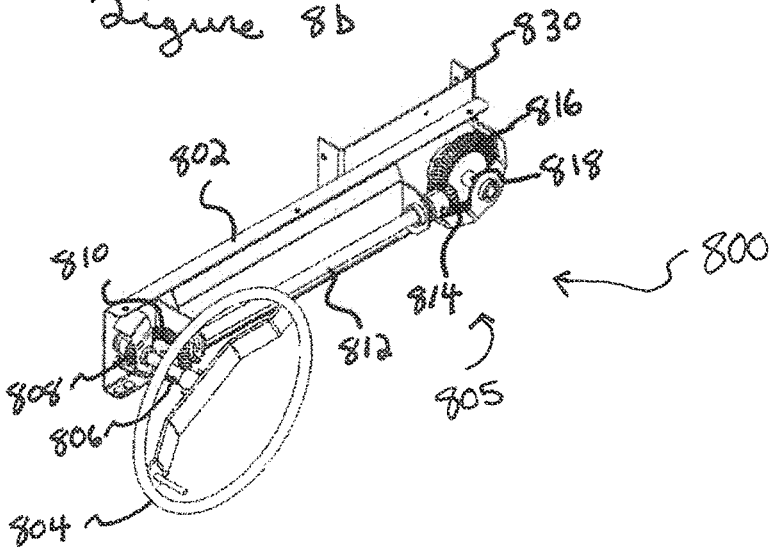

FIGS. 8(*a*)-(*c*) illustrate a perspective view of a drive mechanism for a door control assembly for a dual door control assembly according to an embodiment of the present invention. The door control assembly 800 includes an arm 802, a controller 804 and a drive mechanism 805. The drive mechanism 805 includes moveable members in the form of a beveled gear assembly. The beveled gear assembly of drive mechanism 805 includes a first shaft 806 extending from the controller and a first gear 808 at the end of the shaft. The controller 804, shaft 806 and first gear 808 are located at the second end of the arm 802. The controller 804 may be a hand operable controller, such as a hand wheel. The first gear 808 is fixed to the first shaft 806 such that when the controller 804 is rotated the first shaft 806 and the first gear 808 rotate with the controller. The drive mechanism 805 also includes a second gear 810 at one end of a second shaft 812 and a third gear 814 at the opposite end of the second shaft. The second gear 810 is positioned in mating relation with the first gear 808 such that it is driven by the first gear 808 and any rotation of the first gear 808 is transferred to the second gear 810. The first gear 808 and the second gear 810 can each include a plurality of teeth positioned to engage the teeth of the other gear. In an embodiment of the present invention, the axis of rotation of the first gear 808 can be approximately perpendicular to the axis of rotation of the second gear 810. In an embodiment of the present invention, the second gear 810 is smaller than the first gear 808 to provide more than one rotation of the second gear 810 in response to one rotation of the first gear 808. The second gear 810 may also be larger than the first gear 808 to minimize the user force required to control the door, or the gears may be the same size. The second gear 810 is fixed to the second shaft 812 such that the second shaft 812 rotates with the second gear 810. The third gear 814 is fixed to the second shaft 812 such that the motion of the second gear 810 is transferred to the third gear 814.

The drive mechanism 805 also includes a fourth gear 816 at one end of a third shaft 818 and a fifth gear (not shown) at the opposite end of the third shaft 818. The fourth gear 816 is positioned to the driven by the third gear 814 and any motion of the third gear 814 is transferred to the fourth gear 816. The third gear 814 and the fourth gear 816 can each include a plurality of teeth positioned to engage the teeth of the other gear. In an embodiment of the present invention, the axis of rotation of the third gear 814 can be approximately perpendicular to the axis of rotation of the fourth gear 816. In an embodiment of the present invention, the fourth gear 816 is smaller than the third gear 814 to provide more than one rotation of the fourth gear 816 in response to one rotation of the third gear 814. The fourth gear 816 may also be larger than the third gear 814 or the gears may be the same size. The fourth gear 816 is fixed to the third shaft 818 such that the third shaft 818 rotates with the fourth gear 816. The fifth gear is positioned to drive the rack 114, which causes the door 104 to move up or down, similar to the third gear 140 of the gear and sprocket assembly discussed above. The fifth gear is fixed to the third shaft 818 and the motion of the fourth gear 816 is transferred to the fifth gear. In an embodiment of the present invention, the fifth gear is an approximately circular disc-like member including a plurality of teeth about a circumference thereof and the rack 114 is an elongated member that includes a plurality of teeth arranged in a linear manner. The fifth gear and the rack 114 are positioned such that the teeth of the fifth gear engage the teeth of the rack 114.

In use, when controller 804 is rotated by the user, first shaft 806 and first gear 808 also rotate about the same axis of rotation as the controller. The first gear 403 engages and rotates the second gear 404 and the rotation of the second gear 404 causes the second shaft 406 and the third gear 408 to rotate about the same axis of rotation as the second gear 404. The third gear 408 engages and rotates the fourth gear 410, and its rotation causes the third shaft 412 and the fifth gear to rotate about the same axis of rotation as the fourth gear 410. The fifth gear engages the rack 126 and can move it up or down, which causes the door 104 to open or close.

From the above it will be appreciated that the dual position door control of the present invention allows the door of a farm implement to be opened from at least two operating positions relative to the door. It will also be appreciated that various changes can be made to the system without departing from the spirit and scope of the appended claims. For example, additional mounts could be added to the locking mechanism to allow the door control assembly to be positioned in more than two operating positions. Also, while the locking mechanism is shown having a knob with a threaded shaft, it will be appreciated that various types of pins, latches, and/or spring-biased members can be used in combination with complementary structures on the farm implement to lock the arm of the control assembly in relation to the farm implement. Also, stops can be positioned on the farm implement to abut the arm when it is in the first and second operating positions, respectively, to prevent movement of the arm past these positions and thereby assist the user in engaging the locking mechanism. Furthermore, while a hand wheel is shown for operating the door, other types of hand-operable controllers can be used, such as rotatable hand cranks and movable levers. In addition, drive mechanisms other than chain and sprocket drives can be used, such as belt drives, rack and pinion drives, and/or piston drives. Additionally, the door control system of the present invention can be used on stationary farm implements, such as free-standing storage bins, or mobile farm implements, such as grain wagons, seed tenders, and the like. These and other modifications are intended to be encompassed by the appended claims.

We claim:

1. A door control system for a farm implement with a storage bin having a discharge opening and a door movable between open and closed positions relative to the discharge opening, comprising:

an arm having first and second ends;

mounting means for pivotally connecting said second end of said arm to said storage bin such that said arm is rotatable between at least a first operating position and a second operating position;

a controller connected to said arm and movable in relation thereto;

a drive mechanism for moving the door between the open position and the closed position in response to movement of said controller in relation to said arm when said arm is in any of said operating positions.

2. The system of claim 1, further comprising locking means for locking said arm in at least one of said operating positions.

3. The system of claim 1, wherein said controller includes a hand wheel.

4. The system of claim 1, wherein said drive mechanism includes movable members arranged to move said door between the open position and the closed position in response to movement of said controller when said arm is in any of said operating positions, and further wherein said mounting means includes a pivotable coupling.

5. The system of claim 1, wherein said drive mechanism includes a first shaft, a first gear, a second shaft, a second gear, a third gear, a third shaft, a fourth gear, and a fifth gear wherein:

said controller is coupled to the first shaft and said first gear is coupled to said first shaft, said first gear is positioned to drive said second gear and said second gear is coupled to a first end of said second shaft, a second end of said second shaft is coupled with said third gear and said third gear is positioned to drive said fourth gear, said fourth gear is coupled to said third shaft and positioned to adjust the position of the door.

6. The system of claim 5, wherein said each of said first gear, second gear, third gear and fourth gear are bevel gears.

7. A door control system for a farm implement with a storage bin having a discharge opening and a door movable between open and closed positions relative to the discharge opening, comprising:

an arm having first and second ends;

mounting means for pivotally connecting said second end of said arm to said storage bin such that said arm is rotatable between at least a first operating position and a second operating position;

a controller connected to said arm and movable in relation thereto;

a drive mechanism for moving the door between the open position and the closed position in response to movement of said controller when said arm is in any of said operating positions;

wherein said drive mechanism includes a first shaft, a second shaft, a third shaft, a first sprocket, a second sprocket, a roller chain, a first gear, a second gear and a third gear, and further wherein:

said controller is coupled to said first shaft and said first shaft is rotatably coupled to said arm, said first sprocket is coupled to said first shaft and is coupled with said second sprocket by said roller chain, said second sprocket is coupled to said second shaft and said first gear is coupled to said second shaft, said first gear is positioned to drive said second gear and said second gear is coupled to said third shaft, and said third gear is coupled with said third shaft and positioned to adjust the position of the door.

8. The system of claim 7, wherein said drive mechanism further includes a rack configured to be positioned on said door to engage said third gear.

9. A farm implement comprising:

a storage bin with a discharge opening and a door movable between a closed position covering the discharge opening and an open position exposing the discharge opening; and a door control system including an arm having first and second ends; a controller connected to said arm and movable in relation thereto; and a drive mechanism coupled with said door and said controller, wherein said second end of said arm is pivotally connected to said storage bin so as to be rotatable between at least a first operating position and a second operating position; and wherein said drive mechanism includes movable members arranged to move said door between the open position and the closed position in response to movement of said controller in relation to said arm when said arm is in any of said operating positions.

10. The farm implement of claim 9, further comprising a locking member on said arm that is engageable with a complementary structure on said bin in at least one of said operating positions so as to immobilize said arm when engaged.

11. The farm implement of claim 9, wherein said controller includes a hand wheel.

12. The farm implement of claim 9, wherein said movable members of said drive mechanism include a first shaft, a first gear, a second shaft, a second gear, a third gear, a third shaft, a fourth gear, and a fifth gear wherein:

said controller is coupled to the first shaft and said first gear is coupled to said first shaft, said first gear is positioned to drive said second gear and said second gear is coupled to a first end of said second shaft, a second end of said second shaft is coupled with said third gear and said third gear is positioned to drive said fourth gear, said fourth gear is coupled to said third shaft and positioned to adjust the position of the door.

13. The farm implement of claim 12, wherein said each of said first gear, second gear, third gear and fourth gear are bevel gears.

14. A farm implement comprising:

a storage bin with a discharge opening and a door movable between a closed position covering the discharge opening and an open position exposing the discharge opening; and a door control system including an arm having first and second ends; a controller connected to said arm and movable in relation thereto; and a drive mechanism coupled with said door and said controller, wherein said second end of said arm is pivotally connected to said storage bin so as to be rotatable between at least a first operating position and a second operating position; and wherein said drive mechanism includes movable members arranged to move said door between the open position and the closed position in response to movement of said controller when said arm is in any of said operating positions;

wherein said movable members of said drive mechanism include a first shaft, a second shaft, a third shaft, a first sprocket, a second sprocket, a roller chain, a first gear, a second gear and a third gear, and further wherein:

said controller is coupled to said first shaft and said first shaft is rotatably coupled to said said first sprocket is coupled to said first shaft and is coupled with said second sprocket by said roller chain, said second sprocket is coupled to said second shaft and said first gear is coupled to said second shaft, said first gear is positioned to drive said second gear and said second gear is coupled to said third shaft, and said third gear is coupled with said third shaft and positioned to adjust the position of the door.

15. The farm implement of claim 14, wherein said drive mechanism further includes a rack configured to be positioned on said door to engage said third gear.

16. A door control system for a farm implement with a storage bin having a discharge opening, the door control system comprising:

a door attached to the farm implement and movable between open and closed positions relative to the discharge opening, said door having first and second sides;

a mounting bracket attached to the farm implement vertically spaced above the door and between the first and second sides;

an arm having first and second ends, the arm pivotably coupled to the mounting bracket at the second end, such that the arm is rotatable about an axis projecting orthogonally from the door between at least a first operating position in which said first end of the arm is disposed adjacent to the first side of the door and a second operating position in which said first end of the arm is disposed adjacent to the second side of the door;

a controller connected to the arm at the first end and movable in relation thereto to open and close the door when the arm is in any of the operating positions; and a drive mechanism for moving the door between the open position and the closed position in response to movement of the controller in relation to the arm when the arm is in any of the operating positions.

* * * * *